United States Patent [19]

Kelly

[11] Patent Number: 5,010,351

[45] Date of Patent: Apr. 23, 1991

[54] SLOT RADIATOR ASSEMBLY WITH VANE TUNING

[75] Inventor: Kenneth C. Kelly, Sherman Oaks, Calif.

[73] Assignee: Hughes Aircraft Company, Los Angeles, Calif.

[21] Appl. No.: 477,089

[22] Filed: Feb. 8, 1990

[51] Int. Cl.[5] ..... H01Q 13/10

[52] U.S. Cl. ..... 343/771

[58] Field of Search ..... 343/770, 771, 768

[56] References Cited

U.S. PATENT DOCUMENTS

| | | | |
|---|---|---|---|
| 2,908,905 | 10/1959 | Saltzman | 343/771 |
| 3,193,830 | 7/1965 | Provencher | 343/771 |
| 3,570,007 | 3/1971 | Whitehead | 343/771 |
| 4,429,313 | 1/1984 | Muhs et al. | 343/771 |
| 4,716,415 | 12/1987 | Kelly | 343/771 |
| 4,839,663 | 6/1989 | Kurtz | 343/771 |

FOREIGN PATENT DOCUMENTS

| | | | |
|---|---|---|---|
| 1573604 | 8/1980 | United Kingdom | 343/771 |

OTHER PUBLICATIONS

IRE Transactions on Antennas and Propagation, entitled, "A Slot with Variable Coupling and its Application to a Linear Array", by Raymond Tang, Jan. 1960, p. 97.

*Primary Examiner*—Michael C. Wimer

*Attorney, Agent, or Firm*—Robert A. Westerlund; Steven M. Mitchell; Wanda K. Denson-Low

[57] ABSTRACT

An array antenna (20) that avoids the generation of grating lobes or second order beams is formed of a two-dimensional array of radiating elements (40) disposed in parallel rows (22) and parallel columns (24), each of the radiating elements being formed as slotted apertures within a top broad wall (28) of a waveguide (26). The width of the broad wall is many times greater than the height of a sidewall (32, 34) of the waveguide, the waveguide having a rectangular cross section. A wave launcher (46) connected to a first end of the waveguide launches a higher-order mode of electromagnetic wave wherein the order of the mode is equal to the number of columns of the radiating elements. A set of vanes (48, 48A) upstanding from a bottom wall (30) of the waveguide extend partway towards the top wall to provide values of inductance and capacitance which resonate at the resonant frequency to inhibit reflection of the electromagnetic wave from individual ones of the vanes. Each vane extends in a plane perpendicular to the sidewalls, individual planes of the vanes bisecting slots (40) of the radiating elements, the slots being arranged parallel to the sidewalls. In each column, the locations of vanes are staggered from side to side so as to offset a path of propagation of the wave in the vicinity of the radiating element to reverse a sense of coupling of electromagnetic power from the wave to the radiating element. This produces a uniform phase front from radiations from all of the radiating elements.

10 Claims, 2 Drawing Sheets

SLOT RADIATOR ASSEMBLY WITH VANE TUNING

BACKGROUND OF THE INVENTION

This invention relates to a line array of colinear slot radiators and, more particularly, to an array of plural parallel columns of slot radiators with excitation and phasing of electromagnetic waves controlled by a set of fin-shaped vanes upstanding from a common broad wall of a waveguide or cavity.

An array of slot radiators disposed in a staggered line along a wall of a waveguide is employed frequently to generate a beam of electromagnetic power. As a typical example of an array antenna composed of slot radiators, the antenna comprises a waveguide of rectangular cross section wherein the width of a broad wall is double the height of a narrow wall, and wherein the slots are formed through one of the broad walls. Antennas are constructed also of a plurality of these slotted waveguides arranged side-by-side to provide a two-dimensional array of slot radiators arranged in rows and columns. To facilitate description of the antenna, a column of slot radiators is considered to be oriented in the longitudinal direction, i.e., in the direction of propagation of electromagnetic power in the waveguides, and a row of slot radiators is considered to be transverse to the direction of propagation in the waveguides. An antenna composed of a single waveguide generates a fan beam while an antenna composed of a plurality of the waveguides arranged side by side produces a beam having well-defined directivity in both the plane parallel to the columns and the orthogonal plane parallel to the rows.

Antennas employing slot radiators may have slots which are angled relative to a center line of the broad wall of the waveguide, or may have slots which are arranged parallel to the center line of the broad wall of the waveguide but offset from said center line alternately on one side and the other side. In order to attain a desired linear polarization, and a desired illumination function of the radiating aperture of the entire antenna, the configuration of the antenna of primary interest herein is to be configured with all of the slots being parallel to each other and arranged colinearly in parallel columns. The colinearity eliminates unwanted grating lobes or second order beams.

A cophasal relationship among the radiations from the various slot radiators is employed for generating a broadside beam directed perpendicularly to a plane containing the plurality of waveguides. Herein, the antenna comprising the two-dimensional array of rows and columns of radiators is of primary interest. One method of obtaining the cophasal relationship is to position the slot radiators with a spacing of one guide wavelength. However, such a spacing is sufficiently large to introduce grating lobes to the directivity pattern of the antenna and, accordingly, it is preferred frequently to employ a smaller spacing, typically one half of the guide wavelength, between successive ones of the slot radiators.

However, the spacing of one half guide wavelength introduces a problem because a wave propagating along the waveguide undergoes a phase shift of 180 degrees during propagation through a distance of one-half guide wavelength. Therefore, the requirement of a cophasal relationship is contradicted by the desire to space the radiators at a distance of one-half guide wavelength. Typically, a cophasal result is obtained, despite the half guide wavelength spacing, by alternating the direction of the slot positioning used to achieve slot coupling to the energy in the waveguide.

Also, to facilitate manufacture of the antenna, and to reduce the overall weight of the antenna, it would be preferable to construct the antenna of a single waveguide having broad walls of sufficient width to form multiple columns of slot radiators within a single broad wall. This would eliminate the need for constructing multiple individual waveguides. However, such a constriction of multiple columns of slot radiators within a single broad wall introduces a further problem, namely, that consecutive slot radiators within any row of the array would be excited with radiation which differs in phase by 180 degrees. Thus, the cophasal relationship would not be attained.

SUMMARY OF THE INVENTION

The aforementioned problems are overcome and other advantages are provided by an antenna comprising an array of slot radiators disposed in an arrangement of parallel columns and parallel rows. All of the slot radiators are formed within a single top broad wall of a broad waveguide or cavity having rectangular cross section. The slots of the radiators are parallel to each other and, in a preferred embodiment of the invention, the longitudinal dimension of each slot is oriented parallel to the columns. The waveguide is excited by a transverse electric wave $TE_{n,0}$ wherein n may equal any integer. Associated with each slot radiator is a fin-like resonant vane upstanding from a bottom broad wall of the waveguide. The vanes extend partway from the bottom broad wall towards the top broad wall, but do not contact the top broad wall. This facilitates manufacture in that the assembly of vanes on the lower broad wall and sidewalls of the broad waveguide can be cast or milled as a single assembly Manufacture is then completed by simply placing the top broad wall with the radiating slots therein upon the sidewalls and the end walls to complete the foregoing assembly.

The fin-like vanes are arranged in a manner which can be explained best by reference to an array of imaginary waveguides extending through the waveguide. In the array, each of the imaginary waveguides is relatively narrow having an aspect ratio wherein the width of a broad wall is approximately double the height of a sidewall. The imaginary waveguides are contiguous to each other, and are separated by virtual sidewalls at which there is a zero value of electric field because of the characteristics of the $TE_{n,0}$ mode. All of the vanes are arranged parallel to each other. Within each of the imaginary waveguides, the vanes are disposed at the sites of the slot radiators, are oriented perpendicularly to a center line of the waveguide, and are disposed in alternating fashion relative to a central vertical plane of each imaginary waveguide. In each imaginary waveguide, a vane extends perpendicularly from a virtual sidewall, the extension being a distance of approximately one third of the distance between sidewalls of each imaginary waveguide. Extension of a vane from the bottom broad wall to the top broad wall is approximately 80% of the distance between the two broad walls. In each column of slot radiators, the slots are spaced apart on centers by one-half guide wavelength.

In each of the imaginary waveguides, the alternating positions of the vanes results in a sidewise deflection of the path of propagation of an electromagnetic wave about the central vertical plane of the imaginary waveguide. The alternate offsetting of the path of propagation introduces a reversal in the excitation phase at each slot radiator which cancels the alternation of phase associated with the fact that the slots in each column are spaced only one-half waveguide wavelength apart. This results in cophasal excitation of all the slot radiators within a single column. With respect to two contiguous imaginary waveguides, the array of vanes of one imaginary waveguide is the mirror image of the array of vanes in the other imaginary waveguide. This introduces an alternation of the phase of excitation of successive slot radiators within each row of slot radiators to cancel the phase alternation which is associated with the fact that the $TE_{n,0}$ waveguide mode has an alternation as a fundamental characteristic of the imaginary waveguides. This results n n cophasal excitation of all of the slot radiators in a row.

The desired antenna having slot radiators arranged in rows and columns, spaced apart by one-half of the guide wavelength, is achieved with cophasal radiation from all slots.

BRIEF DESCRIPTION OF THE DRAWING

The aforementioned aspects and other features of the invention are explained in the following description, taken in connection with the accompanying drawing wherein.

DETAILED DESCRIPTION

Figure 1:
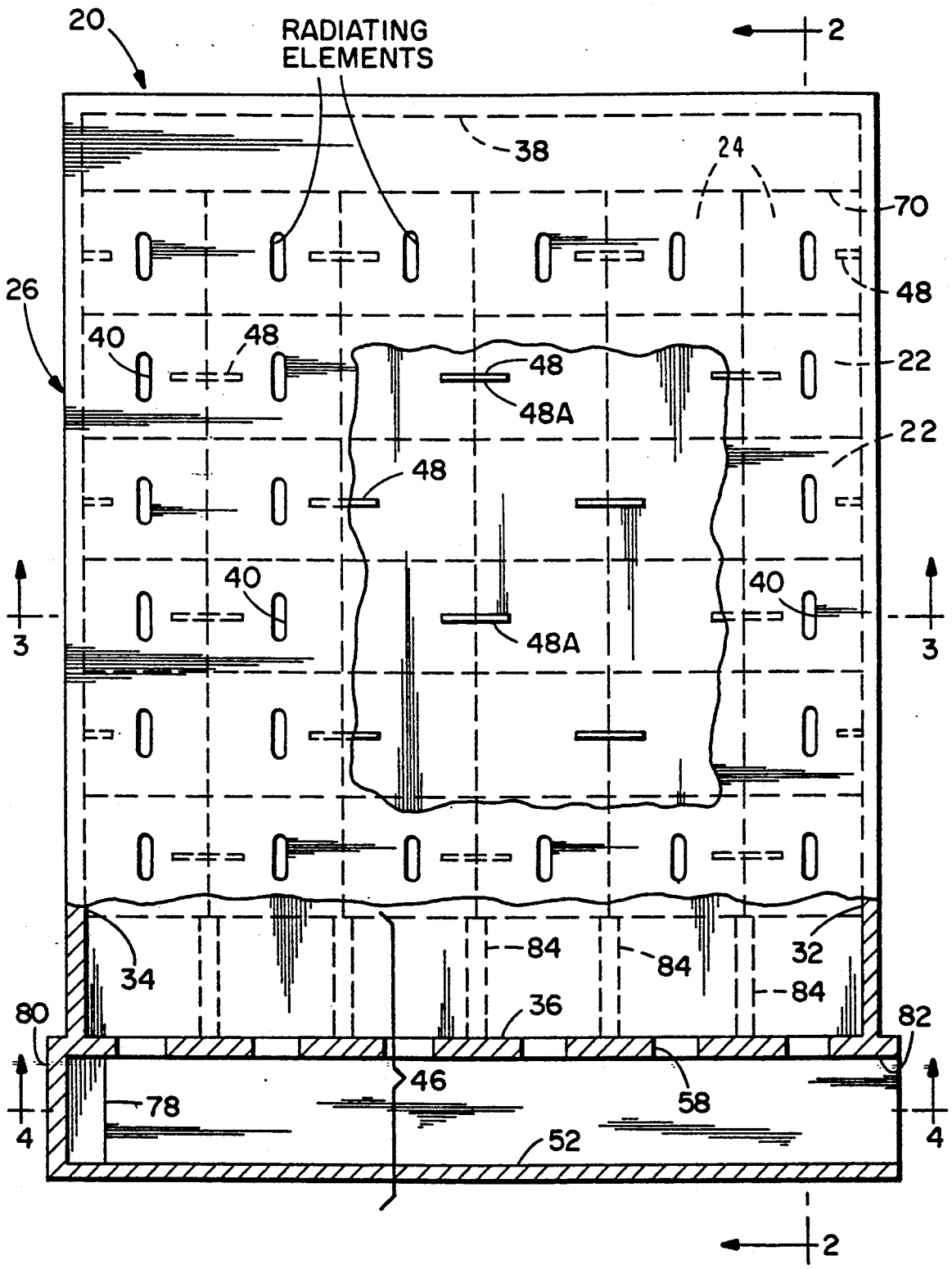
FIG. 1 is a plan view of an antenna constructed in accordance with the invention, the view being partially sectioned as shown in FIG. 2 along line 1—1.

With reference to FIGS. 1–4, there is shown an antenna 20 constructed in accordance with the invention, the antenna 20 having a planar array of radiating elements arranged in a rectangular array and located at sites defined by a set of rows 22 and columns 24. The rows 22 and the columns 24 are indicated by phantom line in FIG. 1. The antenna 20 comprises a microwave structure having the form of a cavity or broad waveguide 26. The waveguide 26 comprises a top broad wall 28, a bottom broad wall 30, a right sidewall 32, a left sidewall 34, a front wall 36, and a back wall 38. The broad walls 28 and 30 are disposed parallel to each other, are spaced apart from each other, and are joined together at their peripheral edges by the sidewalls 32 and 34, the front wall 36 and the back wall 38. The terms "top" and "bottom" are used for purposes of convenience in relating the description of the antenna to the sectional views of FIGS. 2 and 3, and do not imply a preferred orientation to the antenna 20 which may be operated in any desired orientation. Similarly, the terms "right" and "left" are employed to relate the antenna components to the portrayal in FIG. 1, and do not imply any preferred orientation to the antenna 20.

The broad walls 28 and 30, the sidewalls 32 and 34, the front wall 36 and the back wall 38 are each formed of an electrically conductive material, preferably a metal such as brass or aluminum, which produces a totally enclosed space which may be viewed as a cavity or a waveguide. In view of the fact that microwave energy is to be applied at the front wall 36 and extracted from each of the radiating elements, the microwave structure of the antenna will be described as the waveguide 26. There are two embodiments of the waveguide 26, one embodiment employing a traveling wave and having a termination (as will be described hereinafter) to prevent generation of a reflected wave, and the other embodiment employing a standing wave of varying standing-wave ratio and having a shorting end wall to reflect a wave in the reverse direction.

Each of the radiating elements is formed as an aperture within the thin top broad wall 28, each aperture being configured as a longitudinal slot 40 having dimensions of length and width, the length of a slot 40 being many times greater than the width of a slot 40. The longitudinal dimension of each slot 40 is oriented parallel to the direction of the columns 24. The center of each slot 40 is indicated at the center of a square cell defined by the intersecting phantom lines of the rows 22 and the columns 24.

Figure 2:
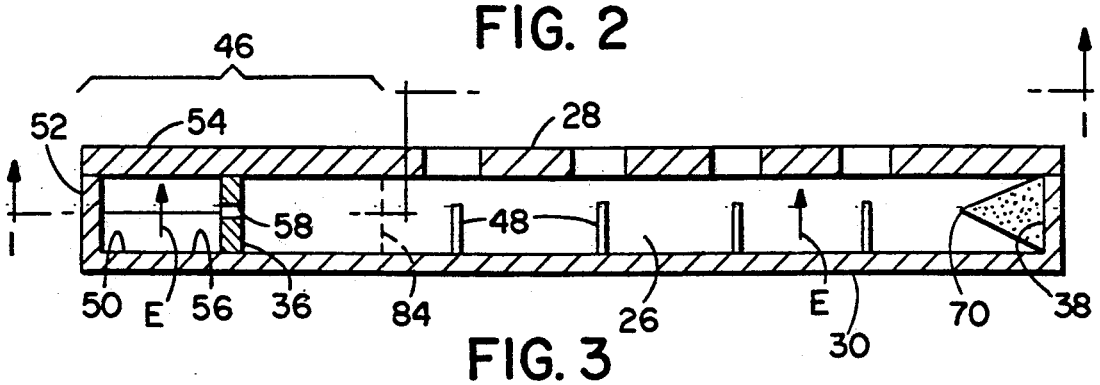
FIG. 2 is a sectional view of the antenna taken along the line 2—2 in FIG. 1.
Figure 3:
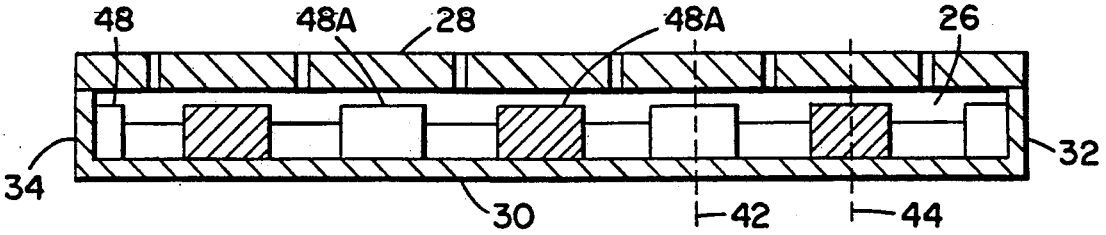
FIG. 3 is a sectional view of the antenna taken along the line 3—3 in FIG. 1.

In describing the waveguides 26, it is convenient to consider a longitudinal view of a column 24 as is disclosed in FIG. 3 between vertical phantom lines 42 and 44, or between lines 44 and the right sidewall 32. With respect to the longitudinal views of the column 24, the portion of the waveguide 26 enclosed within a column has the cross-sectional dimensions of an approximately $2\times1$ (aspect ratio) rectangular waveguide wherein a broad wall has a cross-sectional dimension which is approximately twice the cross-sectional dimension of a sidewall. In view of the numerous columns 24, both of the broad walls 28 and 30 are many times greater in cross-sectional dimension than the sidewalls 32 and 34. This configuration of the cross-section of the waveguide 26 enables the waveguide 26 to support a higher-order rectangular waveguide mode of transverse electric (TE) electromagnetic wave in which the order of the mode is equal to the number of columns. By way of example, there may be 5, 10, or other integer number of columns; the embodiment disclosed in FIGS. 1–4 is provided with six of the columns 24 and six of the rows 22.

In accordance with a feature of the invention, electromagnetic power is to be applied via a higher-order-mode wave launcher 46 located at the front wall 36 for launching a $TE_{6,0}$ wave which travels within the waveguide 26 from the front wall 36 to the back wall 38 past all of the slots 40. Also, in accordance with an important feature of the invention, the antenna 20 includes a set of vanes 48 which are positioned on the bottom broad wall 30 and located in the cell of each slot 40 to direct the electromagnetic wave within the waveguide 26 to propagate along continuous paths to attain a desired coupling of power from the wave to each slot 40. Each vane 48 is formed of a thin sheet of metal upstanding from the bottom broad wall 30 and extending partway towards the top broad wall 28. Each of the vanes 48 has a planar shape and is disposed parallel to the front wall 36. Each of the vanes 48 extends transversely from an edge of a column 24 a distance of approximately one-third of the width of the column 24. The locations of the vanes 48 within the respective columns 24 are staggered from one column to the next column such that an array of vanes 48, as viewed in a column of FIG. 1, is the reverse of an array of the vanes 48 as viewed in the next column of FIG. 1. As a result of the reversal of the array of vanes 48 from column to column, the vanes 48 of contiguous columns are shown in FIG. 1 to abut each other to provide vanes having twice the width of the vanes located at the sidewalls 32 and 34. The wider configuration of vane provided by abutment of vanes of contiguous columns 24 is identified in FIGS. 1 and 3 by the legend 48A. In FIG. 1, a portion of the top broad wall 28 is cut away to show the wider configuration of vane 48A.

The launcher 46 comprises a waveguide 50 having a rectangular cross section and being formed of the aforementioned front wall 36 which serves as a sidewall of the waveguide 50, and a second sidewall 52 opposite the wall 36. The waveguide 50 includes top and bottom broad walls 54 and 56 which are joined by the walls 36 and 52. The transverse dimension of each of the broad walls 54 and 56 is approximately double the transverse dimension of each of the walls 36 and 52 to provide an approximately $2\times1$ aspect ratio to a cross section of the waveguide 50. Coupling slots 58 are located in the front wall 36, each coupling slot having a linear form with a length and a width, the length being many times greater than the width. The coupling slots 58 are oriented with their sides parallel to the broad walls 56 and 58, the coupling slots 58 being located half-way between the broad walls 54 and 56. The slots 58 are spaced apart on centers by one-half the guide wavelength in the longitudinal direction along the waveguide 50. The waveguide 50 is energized with an electromagnetic wave in the $TE_{1,0}$ mode in which the electric field is perpendicular to the broad walls 54 and 56 as shown in FIG. 2. The electric fields coupled through each of the slots 58 induce the aforementioned transverse electric wave in the waveguide 26 with electric field disposed perpendicularly to the broad walls 28 and 30 as shown in FIG. 2. The actual dimensions of the antenna 20 and of the launcher 46 are selected in accordance with the frequency of electromagnetic power to be radiated from the antenna 20. By way of example, an experimental model of 90 slots arranged in 9 rows and 10 columns was operated successfully in the standing wave mode at 9.2 GHz (gigahertz).

Figure 5:
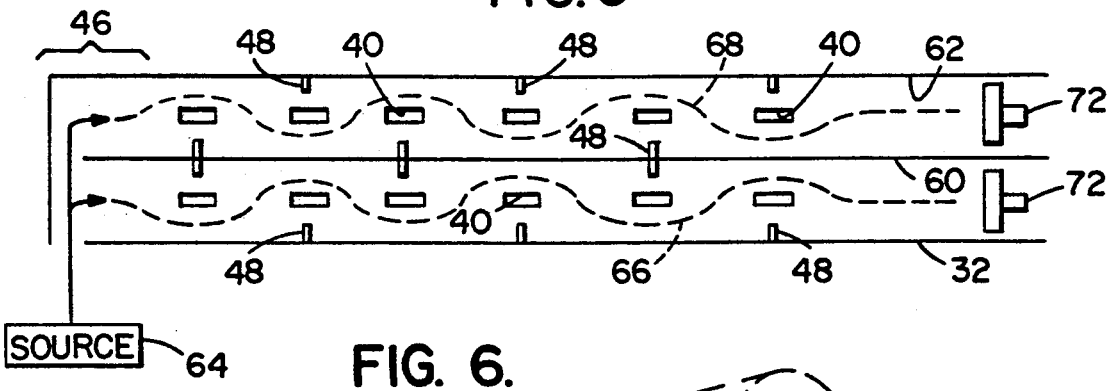
FIG. 5 is a diagrammatic view of two adjacent columns of slotted radiating apertures of the antenna of FIG. 1, FIG. 5 showing a sinuous path to radiation induced by vanes interposed within paths of propagation of electromagnetic power.

FIG. 5 shows diagrammatically a representation of the portion of the electromagnetic wave traveling in the two right hand columns of FIG. 3, namely, between the dashed line 44 and the sidewall 32, and between the two dashed lines 42 and 44. As is well known in the generation of a higher order transverse electric wave, the electric field experiences a null periodically when viewed in a direction transverse to the direction of propagation of power along the waveguide 26. With respect to FIG. 3, three of these nulls are located, respectively, at the right sidewall 32, at the line 44, and at the line 42. Additional nulls are located at the boundaries between consecutive ones of the columns 24. Thus, from a point of view of analyzing the propagation of electromagnetic power along each of the columns 24, one could interpose imaginary electrically conductive sidewalls along the dashed lines representing the columns 24. This has been done in FIG. 5 wherein lines 60 and 62 represent such imaginary sidewalls. Electromagnetic power is provided by a suitable microwave source 64, is coupled to the launcher 46 which launches the higher-order TE wave along the waveguide 26. With reference to the portion of the waveguide 26 presented in FIG. 5, output power from the launcher 46 is represented as two separate waves 66 and 68 which travel along continuous paths indicated by the dashed lines of the waves 66 and 68. The sinuous paths are produced by the presence of the vanes 48.

The operation of the vanes 48 in deflecting an electromagnetic wave, such as the wave 66 or 68, from a straight path of propagation of electromagnetic power along a waveguide may be understood with reference to a structure involving a slot, rather than a vane, for deflecting a wave as is disclosed in an article appearing in the IRE Transactions on Antennas and Propagation, entitled A Slot With Variable Coupling and its Application to a Linear Array by Raymond Tang, January 1960, particularly FIG. 1 on page 97. Therein, a longitudinally slotted aperture radiating element is disposed in the broad wall of a rectangular waveguide. As is well known, the coupling of electromagnetic power from a wave conducted within the guide via the slot to radiate outside the waveguide is accomplished by interaction of longitudinal components of the magnetic field of the electromagnetic wave with the longitudinal sides of the slot. In many antenna arrays of radiated elements, optimal positioning of the radiating elements, such as slotted radiator elements, is attained by placing the slotted aperture directly on the center line of the broad wall. However, at this location, only a transverse component of the magnetic field is present so that the desired coupling of electromagnetic power through the slotted aperture docs not occur. In the foregoing article by Tang, an iris is formed within the waveguide at the site of the slotted aperture and, furthermore, the iris is offset from a central plane of the waveguide. This results in a deflection of the electromagnetic wave so that a longitudinal component of the magnetic field is present at the slotted aperture resulting in the coupling of electromagnetic power from the wave via the slot to be radiated outside of the waveguide.

The concept of deflection of the wave is employed in the present invention. However, in lieu of the microwave structure of an iris, the present invention employs the microwave structure of a vane to deflect an electromagnetic wave. It is noted that the condition of zero longitudinal component of magnetic field is present only along a central vertical plane in a $2\times1$ rectangular waveguide excited by a $TE_{1,0}$ mode of excitation. Furthermore, by displacing a slot sideways towards one of the sidewalls, there is adequate longitudinal magnetic field component for successful coupling of power through a longitudinal slot in the broad wall. However, if one is to maintain the position of the slot along the central vertical plane of the waveguide, as is required for optimal positioning of the radiating elements of an array antenna, then the structure of the invention must be employed to deflect the wave from its normal course so as to bring the desired longitudinal magnetic field component alongside the slot.

To facilitate manufacture of an antenna, such as the antenna 20 with its wave launcher 46, it is desirable to have all microwave structural components secured only to the bottom broad wall and, possibly, also secured to one or more of the sidewalls. However, no such components, other than slotted apertures, should be provided on the top broad wall. Such an arrangement of the microwave components facilitates manufacture because an assembly of the components which form the antenna 20 can be readily molded and machined as a single unitary structure after which the top broad wall is simply brought into place and positioned in the manner of a cover to the assembly. It is considerably more difficult to fabricate a microwave structure in which microwave components must be secured to both the top and the bottom broad walls. In this respect, it is noted that resonant irises in rectangular waveguides operating in the dominant mode of electromagnetic wave propagation are difficult to construct because they are built usually by having a portion of the iris in electrical and physical contact with both the top and the bottom broad walls. The present invention avoids this difficulty of construction by employing the vanes which are located on the bottom broad wall and extend only partway to the top broad wall. It is noted that the theory of the invention applies also to waveguides of other configurations, even to a waveguide of solid dielectric slab in which perturbations in the outer surface can be used to deflect an electromagnetic wave propagating by total reflection within the waveguide.

Figure 4:
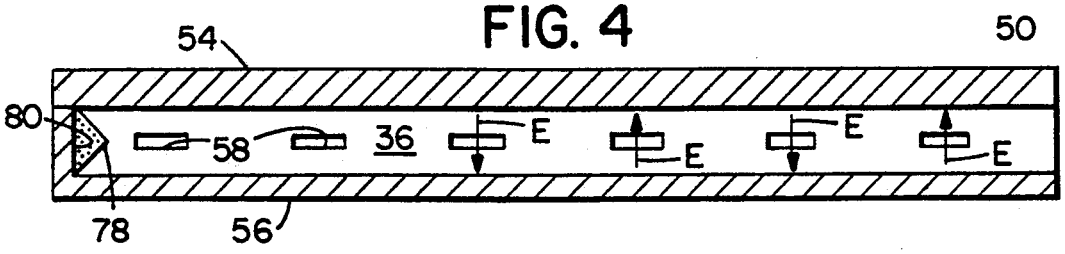
FIG. 4 is a sectional view of the antenna taken along the line 4—4 in FIG. 1.

Each of the slots 40 has a length of approximately one half of a free space wavelength. The slots 40 are spaced apart along a column 24 with a spacing on centers of one half of the guide wavelength. The slots 40 arc spaced apart along a row 22, a distance measured on centers of approximately 0.7 free-space wavelength. In the waveguide 50 of the launcher 46, the direction of the electric field vector, E, alternates in phase from one of the coupling slots 58 to the next of the coupling slots 58, as indicated in FIG. 4. This produces the alternation in the sense of electric fields in the waveguide 26 which is characteristic of the alternation in the electric field sense of a higher-order mode of TE wave in a direction transverse to the direction of propagation of power. This alternation in the sense of the electric field is compensated by the emplacement of the vanes 48 relative to the slots 40, as shown in FIG. 5, so as to produce a coupling of the magnetic field vector of opposite sense at the slots 40 of the two imaginary waveguides depicted in FIG. 5. Thus, in the first imaginary waveguide of FIG. 5 bounded by the lines 60 and 62, the wave 68 passes above the first slot 40 at the left of the figure while, in the second imaginary waveguide bounded between the wall 32 and line 60, the path of the wave 66 passes below the first slot 40 at the left end of the figure. Accordingly, radiations from all of the slots 40 are in phase. Also, the radiation from all the slots 40 have the same polarization in view of the parallel disposition of all of the slots 40.

As noted above, the waveguide 26 can be operated in a standing wave mode or in a traveling wave mode. In the traveling wave mode, a terminating load 70 is located at the back wall 38 to absorb power of the forwardly propagating electromagnetic wave which has not been coupled out of the waveguide by the slots 40. The forwardly propagating electromagnetic wave is more intense at the first row of slots 40, adjacent the launcher 46, than n the last row of slots 40 adjacent the back wall 38. Therefore, it is desirable to enlarge (not shown in the drawing) the slots 40 of the last row relative to the size of the slots 40 of the first row, and also to extend the transverse dimension of the vanes 48 of the last row relative to the dimensions of the vanes 48 of the first row so as to enlarge the amount of power coupled from the slots of the last row. In this way, all of the slots radiate the same amount of power.

In the standing wave mode, the load 70 is not used and, instead, the position of the back wall 38 is located at a distance of one-quarter of the guide wavelength (or an odd number of one-quarter wavelengths) beyond the centers of the slots 40 of the last row so as to form a short circuit to the electromagnetic wave. Thereby, a portion of the forwardly propagating electromagnetic wave is reflected back from the back wall 38 to produce a standing wave of varying standing-wave ratio from which all of the power radiates through the slots 40 into space outside the waveguide 26. A maximum standing wave ratio is produced at the back wall 38, the standing wave ratio dropping in value towards the portion of the waveguide 26 near the front wall 36 due to extraction of power from the wave through the slots 40. The structure of the antenna 20 resembles that of a cavity wherein all of the slots 40 may be fabricated of the same size, and all of the vanes 48 may be fabricated to be the same size, with all of the slots 40 radiating equal amounts of electromagnetic power. Proper positioning of the back wall 38 from the last row of the slots 40 is indicated schematically in FIG. 5 by adjustable end walls 72. In the construction of the preferred embodiment of the invention, the appropriate position of the back wall 38 is ascertained, and the back wall 38 is constructed at a fixed location from the last row 22 of the slots 40.

Figure 6:
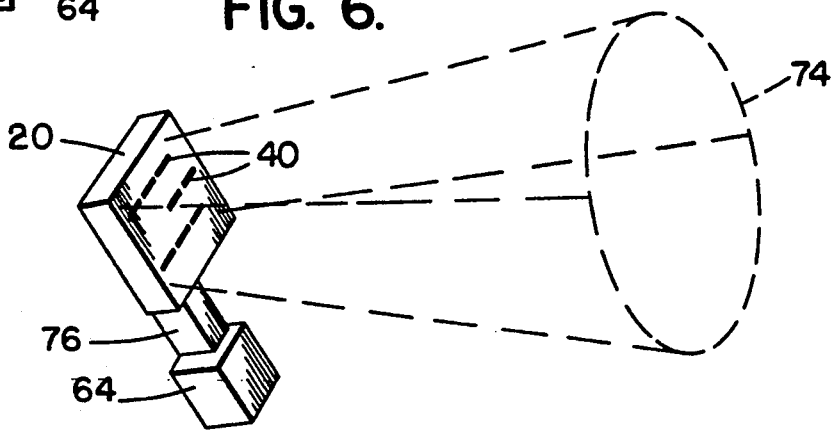
FIG. 6 is a stylized perspective view of the antenna of FIG. 1 energized by microwave power to produce a beam of electromagnetic radiation.

It is to be understood, however, that in a practical situation for the radiation of a beam 74 of electromagnetic power, as depicted in FIG. 6, it is often desirable to introduce an amplitude taper in which the sizes of the slots and the extensions of the vanes are selected to produce a desired amplitude taper as is useful in shaping the beam 74. The beam 74 radiates broadside from the top broad wall 28 of the antenna 20. The coupling of the source 64 to the antenna 20, for example by use of a waveguide 76, allows the source 64 to be located at a place of convenience wherein the broadside beam is unobstructed by the source 64.

In the construction of the launcher 46, there is also a choice of operating modes, namely to use the traveling wave mode or the standing wave mode. In the case of the standing wave mode, a terminating load 78 is disposed in the front of an end wall 80 of the waveguide 50, the end wall 80 extended between the walls 36 and 52, and between the broad walls 54 and 56. Thereby, power inputted from the source 64 at an input port 82 of the waveguide 50 propagates down the waveguide 50 towards the end wall 80, most of the power being coupled via the slots 58 into the waveguide 26 while the remainder of the power is absorbed in the load 78.

In the alternative mode of operation, the load 78 is deleted, and the end wall 80 is positioned one quarter of the guide wavelength (or an odd number of one-quarter wavelengths) beyond the center of the last of the coupling slots 58 to reflect the electromagnetic wave back towards the input port 82. This produces a standing wave of maximum standing wave ratio at the end of the waveguide 50 near the end wall 80, the standing wave ratio dropping in value towards the portion of the waveguide 50 near the input port 52 due to extraction of power from the wave through the coupling slots 58.

The first row 22 of the slots 40 is spaced away from the front wall 36 by a distance of at least one-quarter from the guide wavelength, preferably one-half of the guide wavelength, to allow for the radiations from the respective coupling slots 58 to combine to produce the higher-order mode TE wave. If desired, short sections of electrically conductive walls 84 (shown in phantom in FIGS. 1 and 2) may be employed at the interface between contiguous ones of the columns 24, the walls 84 extending outward from the front wall 36 towards the back wall 38 a distance of one-half of the guide wavelength, the walls 84 extending in height from the bottom broad wall 30 to the top broad wall 28. The walls 84 may be incorporated into the launcher 46 to form the higher-order mode TE wave if desired; however, good performance of the launcher 46 has been attained in an experimental model of the antenna 20 without use of the walls 84.

In the construction of each of the vanes 48, it is noted that the vane acts as an inductive element, and that the space between the top of the vane and the bottom surface of the top broad wall 28 acts as a capacitive element. In terms of an electrical equivalent circuit of the waveguide 26, the capacitive and inductive elements appear in parallel. Therefore, by selecting the values of inductance and capacitance to resonate at the frequency of the electromagnetic wave, the combined impedance of the inductive and capacitive elements presents essentially no loading of the waveguide 26 so that the wave can propagate without any effect of loading by the vanes 48. The only effect is the introduction of the sinuous propagation path. Therefore, from the point of view of introduction of phase shift and attenuation, the vanes 48 may be regarded as having essentially no effect on the propagating characteristics of the electromagnetic wave. The only effect of the vanes 48 is the beneficial effect of offsetting a path of propagation of the wave so as to enhance coupling of the wave to the slots 40.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. An array antenna, comprising:

a hollow waveguide of rectangular cross-section having first and second opposed broadwalls, and first and second opposed sidewalls, joined together along their respective longitudinal edges, said broadwalls and said sidewalls being comprised of conductive material to thereby render said waveguide capable of supporting the propagation of an electromagnetic wave through said waveguide, along the longitudinal dimension thereof;

a matrix of radiating slots provided in said first broadwall, said matrix being defined by a plurality M of rows of said slots, and a plurality N of columns of said slots, with each of said slots being oriented with its longitudinal dimension substantially parallel to the longitudinal dimension of said waveguide;

a plurality of vanes provided on said second broadwall and extending only partially across the internal height dimension of said waveguide, said vanes being configured with relation to each said column of slots in an alternating pattern such that successive ones of said vanes corresponding to successive rows of a column are located on opposite sides of said slots occupying said successive rows of that column;

wherein said vanes each lie in a plane disposed transverse to said sidewalls of said waveguide;

wherein the width of said broadwalls is at least N times greater than the height of said sidewalls; and, wherein said vanes function to provide a sinuous path of propagation of said electromagnetic wave along each said column of slots so as to enhance coupling of said electromagnetic wave through said slots.

2. The antenna as set forth in claim 1, further comprising a wave launcher disposed at a first end of said waveguide for directing electromagnetic power past said vanes toward a second end of said waveguide, said launcher operating to launch said electromagnetic wave for propagation through said waveguide.

3. The antenna as set forth in claim 1, wherein said electromagnetic wave is of a higher-order mode, the order of the mode being equal to the number N of said columns of slots.

4. The antenna as set forth in claim 1, wherein each of said vanes has a bottom edge and a top edge, said bottom edge being attached to said second broadwall and said top edge being spaced-apart from said first broadwall.

5. The antenna as set forth in claim 1, wherein said slots of each said column of slots are disposed in collinear relationship to one another.

6. The antenna as set forth in claim 4, wherein each said vane is comprised of a thin sheet of metal.

7. The antenna as set forth in claim 1, wherein said alternating patterns of said vanes corresponding to successive columns of said matrix of radiating slots are reversed, such that said vane pattern corresponding to successive columns are mirror images of one another.

8. The antenna as set forth in claim 7, wherein said wave launcher introduces a phase shift of 180 degrees to said electromagnetic wave between successive ones of said columns.

9. The antenna as set forth in claim 7, wherein said vanes corresponding to successive ones of said columns abut one another.

10. The antenna as set forth in claim 9, wherein each of said vanes lies in a plane which bisects its corresponding slot.

* * * * *